US005333199A

United States Patent [19]

Kuwasaki

[11] Patent Number: 5,333,199

[45] Date of Patent: Jul. 26, 1994

[54] DIGITAL SIGNAL PROCESSOR FOR SIMULTANEOUSLY PROCESSING LEFT AND RIGHT SIGNALS

[75] Inventor: Kiyoshi Kuwasaki, Kanagawa, Japan

[73] Assignee: NEC Corporation, Tokyo, Japan

[21] Appl. No.: 904,515

[22] Filed: Jun. 25, 1992

[30] Foreign Application Priority Data

Jun. 25, 1991 [JP] Japan ..... 3-182040

[51] Int. Cl.[5] ..... H04R 5/00

[52] U.S. Cl. ..... 381/1; 364/275; 395/325

[58] Field of Search ..... 381/1; 364/275

[56] References Cited

PUBLICATIONS

Ash, Daniel B., "Enhanced Performance Single Chip DSP Requires Minimal External Circuitry," Maple Press, 1988.

Fulcher, John, *An Introduction to Microcomputer Systems*, Addison-Wesley, 1989.

*Primary Examiner*—Curtis Kuntz

*Assistant Examiner*—Mark D. Kelly

*Attorney, Agent, or Firm*—Sughrue, Mion, Zinn, Macpeak & Seas

[57] ABSTRACT

A data input/output circuit of a digital signal processor of the invention includes a converter circuit for serial-parallel conversion of data, an R-channel dedicated input latch circuit, two L-channel dedicated input latch circuits, an L-channel dedicated output latch circuit, an R-channel dedicated output data latch circuit, a multiplexer for switching output data, an edge detection circuit, a rising edge detection circuit, and a falling edge detecting circuit. The circuits 14, 14*a* and 14*b* supply latch or switching timing signals to the above circuits. Thus, the R-channel data and L-channel data can be transferred to other functional blocks through an internal bus during one sampling period. Thus, the right channel data and the left channel data are processed simultaneously, so that the signal processing time can be made unrelated to the input/output data.

5 Claims, 4 Drawing Sheets

DIGITAL SIGNAL PROCESSOR FOR SIMULTANEOUSLY PROCESSING LEFT AND RIGHT SIGNALS

BACKGROUND OF THE INVENTION (1) Field of the Invention

The present invention relates to a digital signal processor for processing inputted right channel data (hereinafter called "R-ch data") and left channel data (hereinafter called "L-ch data") of an audio signal and, more particularly, to a digital signal processor which can simultaneously process the R-ch data and L-ch data of the audio signal.

(2) Description of the Prior Art

A typical conventional digital signal processor to which the present invention relates is shown in FIG. 1. As shown in FIG. 1, the conventional digital processor comprises: an input/output circuit (SIO) 10 for receiving input data DI and for outputting output data DO; a data memory unit 1 for storing an internal data; arithmetic circuit 2 for performing such process as a digital filtering process on the input data DI; a data delay control circuit 4 for controlling an external memory 5 for delaying the data; and a microprogram control circuit 3 for controlling the data memory unit 1, the arithmetic circuit 2 and the data delay control circuit 4. Specifically, the data input/output circuit (SIO) 10 includes a converter circuit (SR) 11 for converting the data from "serial" to "parallel" in its data format for the input data or for converting the data from "parallel" to "serial" for the output data; an input latch circuit (SI) 12 for latching or holding the input data DI; an output latch circuit (SO) 13 for latching or holding the output data DO; and an edge detection circuit (ED) 14.

Now, referring to a timing chart of FIG. 2, an actual operation of the conventional digital signal processor described above will be explained. First, the input data DI inputted to the data input/output circuit 10 is converted from serial data to parallel data. At this time, control signal BCLK is supplied from outside as a clock signal. A signal LRCK indicates whether the input/output data is L-ch data or R-ch data. Specifically, its "L" level designates the L-ch data whereas its "H" level designates the R-ch data. The control signal LRCK is edge-detected by the edge detection circuit (ED) 14, and the above input data DI, which having been converted into the parallel data by the converter circuit 11, is latched in the input latch circuit 12 at the timing of the detected edge. The signal processing for the input data DI latched in the input latch circuit 12 is started at the rising edge timing of the control signal LRCK. Thus, the input data is subjected to the digital filtering processing by the arithmetic circuit 2 and the digital delay processing by data transfer for the external memory 5 through the data delay control circuit 4. In the conventional signal processor, it should be noted that the above processing is performed sequentially and individually for the L-ch data and the R-ch data. The result of signal processing performed as above is latched in the output latch circuit 13 through an internal bus 20.

The above signal processing process is continued until the rising edge timing of the succeeding control signal LRCK. Further, the data latched in the output latch circuit 13 is loaded into the conversion circuit 11 in response to the timing of the edge signal E from the edge detection circuit 14, and after the loaded data is converted from parallel to serial data in its data format, it is outputted as the output data DO. Thus, special sound effects such as a reflected sound and an echo sound can be realized by the above signal processing steps.

However, in the above conventional digital signal processor, although it processes the R-ch data after the process on the L-ch data has been completed, it does not follow that, upon completion of the processing for the L-ch data, a new R-ch data has necessarily been latched in the input latch circuit 12.

Therefore, as the case may be, the processing for the R-ch data cannot be started until the falling edge timing of the signal LRCK in response to which the R-ch data is latched into the input latch circuit 12. In contrast, if the processing for the L-ch data takes so long a time that it is not completed until the falling edge timing of the signal LRCK, the changing point of the signal LRCK does not come while the L-ch data is latched in the output latch circuit 13, so that the L-ch data will not be outputted as the output data DO. As a result, in the conventional digital signal processor, it is to be noted that the signal processing time for the L-ch data and the R-ch data cannot be allowed to be longer than a half clock cycle of the signal LRCK. This is a problem with the conventional digital signal processor to be solved by the present invention.

SUMMARY OF THE INVENTION

It is, therefore, an object of the invention to overcome the problems in the conventional digital signal processor and to provide an improved one in which the signal processing time is not limited by the input/output data.

According to one aspect of the invention, there is provided a digital signal processor having a data input/output circuit for inputting/outputting a right channel data and a left channel data of an audio signal and means for processing the inputted right channel and left channel data, the data input/output circuit comprising:

a data conversion circuit for performing a serial-parallel conversion on the inputted data and for performing a parallel-serial conversion on an output data to be outputted;

an R-channel dedicated input latch means and an L-channel dedicated input latch means for latching the inputted R-channel and L-channel data, respectively;

an R-channel dedicated output latch circuit and an L-channel dedicated output latch circuit for latching the R-channel data and the L-channel data to be outputted, respectively;

an output data switching circuit for switching the data to be outputted therefrom between the R-channel data and the L-channel data sent respectively from the R-channel and L-channel dedicated output latch circuits; and a timing signal generating means for controlling the timings of data latching at each of the input latch means and of data loading from the output data switching circuit to the data conversion circuit.

In operation, the data input/output circuit latches the input data divided into an R-ch data and an L-ch data and then outputs these separate data to the internal bus at the same timing coincident with the falling edge timing of the control signal. The data input/output circuit latches the output data divided into an R-ch data and an L-ch data and selects either of these data to be outputted in accordance with the control clock signal.

Thus, the data processing device can process the R-ch data and L-ch data of the input data simultaneously, so that the signal processing time can be made unrelated to the input/output data.

Outputting the R-ch data and L-ch data of the input data to the internal bus at the same timing can be achieved by latching either one of these channel data at the rising edge timing of the control signal and also by latching the above latched data and the other channel data at the falling edge timing of the control signal.

BRIEF DESCRIPTION OF THE DRAWINGS

The above and other objects, and features and advantages of the present invention will be more apparent from the following description of a preferred embodiment of the present invention explained with reference to the accompanying drawings, in which.

DESCRIPTION OF THE PREFERRED EMBODIMENT

Figure 1:
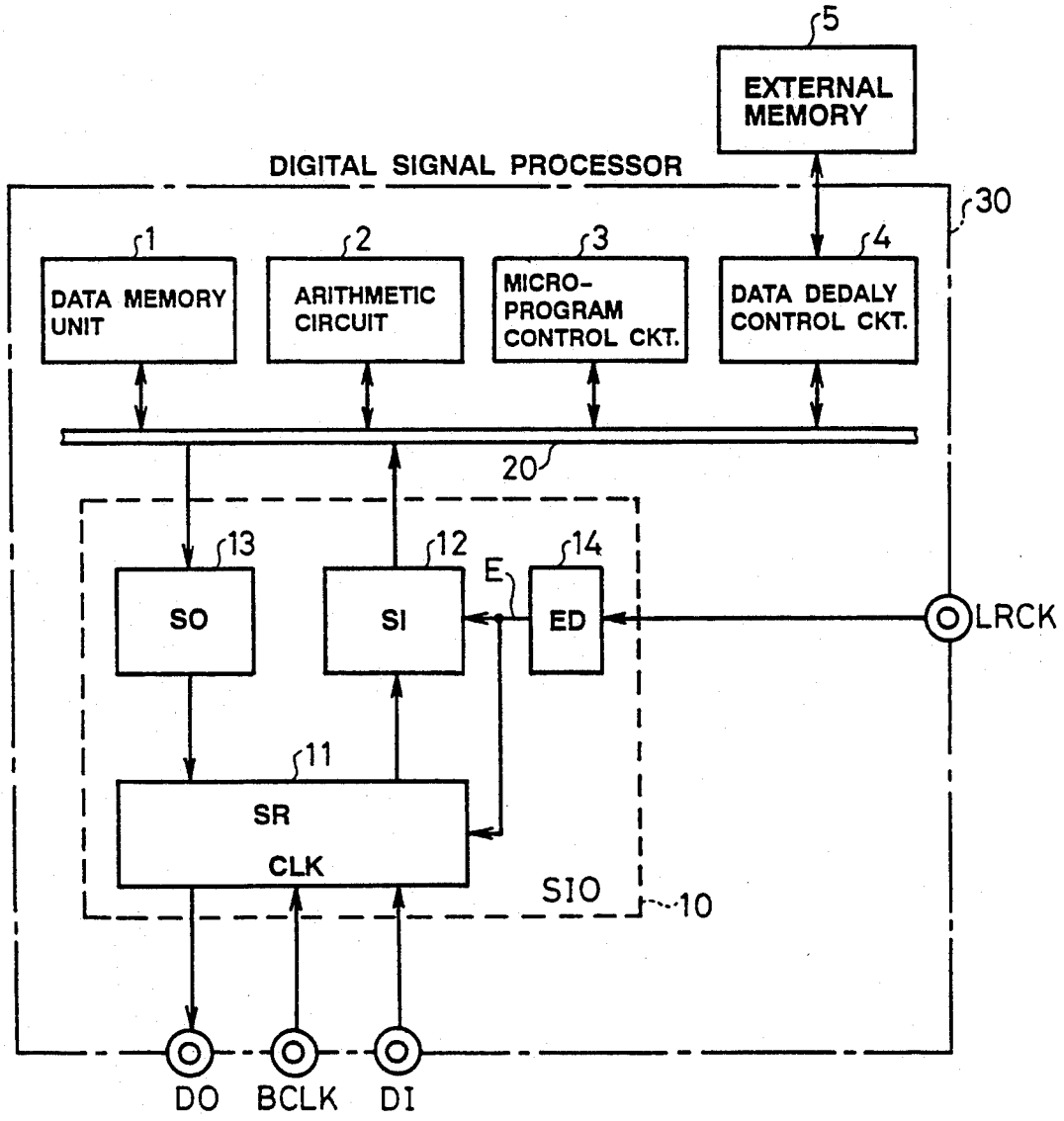
FIG. 1 PRIOR ART
FIG. 1 is a block diagram of a conventional digital signal processor.
Figure 2:
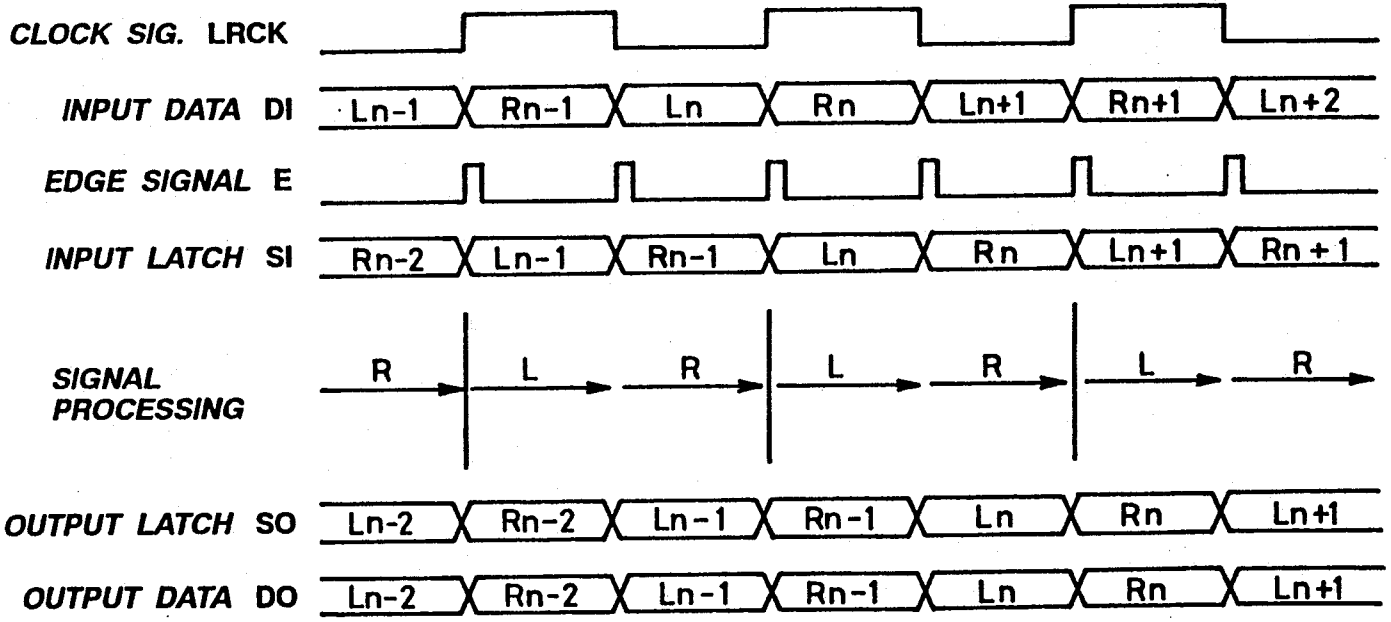
FIG. 2 PRIOR ART
FIG. 2 is a timing chart for explaining the operation of the conventional processor shown in FIG. 1.

Now, a preferred embodiment of the invention will be explained with reference to the accompanying drawings. The reference numerals or symbols used in FIGS. 1 and 2 are also used for the same or like elements in FIGS. 3 and 4 for the embodiment.

Figure 3:
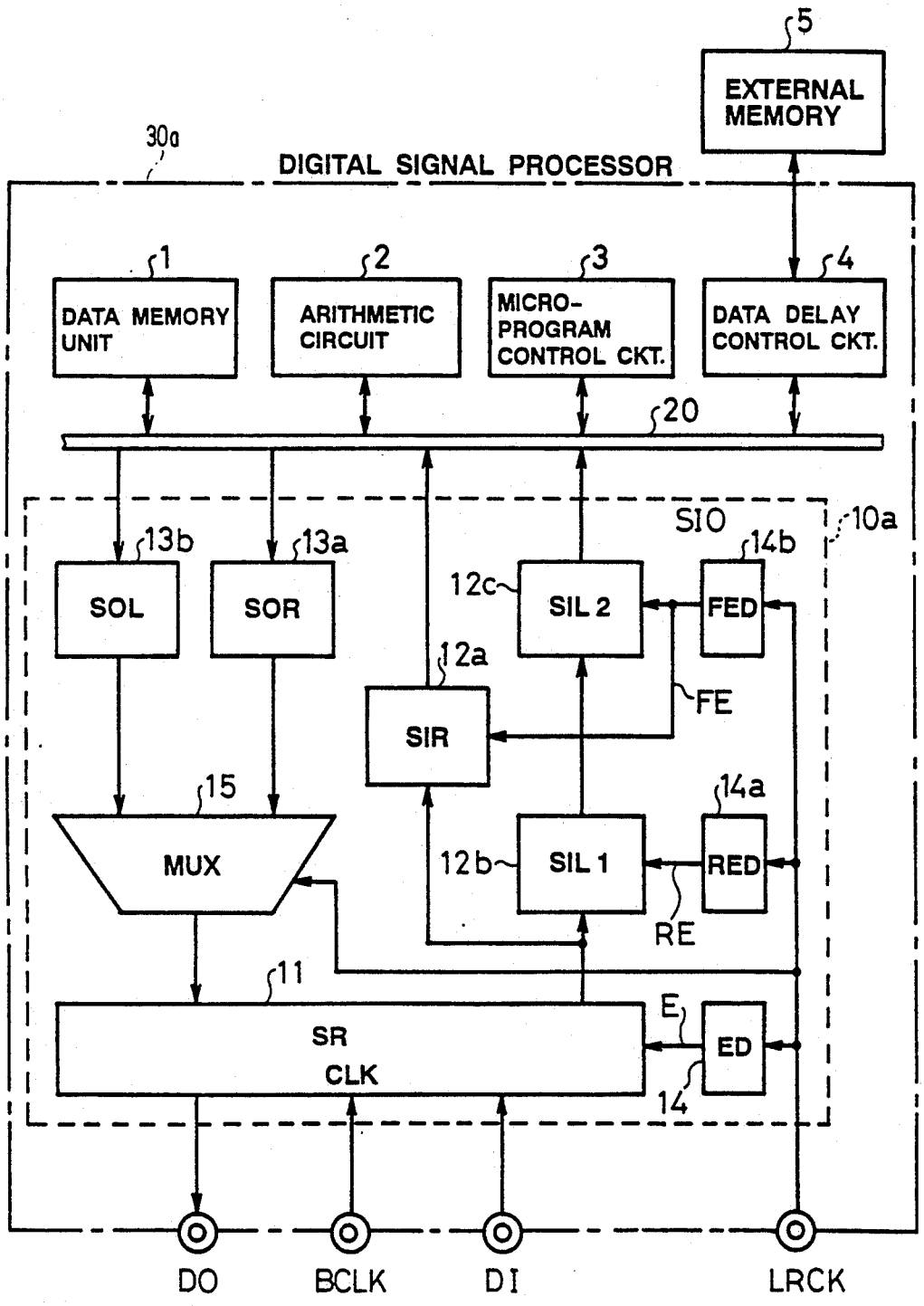
FIG. 3 is a block diagram of a digital signal processor of an embodiment according to the invention.

FIG. 3 is a block diagram showing a digital signal processor of an embodiment according to the present invention.

A digital signal processor 30*a* according to this embodiment comprises: a data memory unit 1 for storing internal data; an arithmetic circuit 2 for performing such processing as digital filtering processing on input data DI; a data delay control circuit 4 for performing data delay processing by controlling an external memory 5 for delaying the data; a data input/output circuit (SIO) 10*a*; a microprogram control unit 3 for controlling the data input/output circuit 10*a*, the data memory unit 1, the arithmetic circuit 2 and the data delay control circuit 4; and an internal data bus 20.

The data input/output circuit 10*a* which features the present invention includes a converter circuit (SR) 11 for controlling the input/output of the input data DI and the output data DO to convert the input data from "serial" to "parallel" and vice versa in its data format; an R-channel dedicated input latch circuit (SIR) 12*a* for latching or holding the R-ch input data DI; two L-channel dedicated input latch circuits (SIL1, SIL2) 12*b* and 12*c*; and L-channel dedicated output latch circuit (SOL) 13*b* for latching or holding L-ch output data; an R-channel dedicated output latch circuit (SOR) 13*a* for holding or latching R-ch output data; and a multiplexer (MUX) 15 which serves as an output data switching circuit for switching or selecting the L-ch data or the R-ch data of the output data DO.

The data input/output circuit 10*a* further includes, as a timing signal generating circuit, an edge detection circuit (ED) 14 for detecting the edges of a control signal LRCK; a rising edge detection circuit (RED) 14*a* for detecting the rising edge of the control signal LRCK; and a falling edge detecting circuit (FED) 14*b* for detecting the falling edge of the control signal LRCK.

Next, referring to the timing chart shown in FIG. 4, an actual operation of this embodiment will be explained below.

The input data DI inputted to the data input/output circuit 10*a* is converted by the converter circuit 11 from serial to parallel data in accordance with the control signal BCLK. The parallel input data DI is latched in such a way that the L-ch data therein is latched by the L-channel dedicated input latch circuit 12*b* in response to the rising edge signal RE of the control signal LRCK, which is detected by the rising edge detecting circuit 14*a*. Then, in response to the falling edge signal FE of the control signal LRCK which is detected by the falling edge detecting circuit 14*b*, the data latched in the L-channel dedicated input latch circuit 12*b* is transferred to and latched in the different L-channel dedicated input latch circuit 12*c* and, at the same time and in the same manner, the R-ch data of the parallel input data DI is latched in the R-channel dedicated input latch circuit 12*a*.

Figure 4:
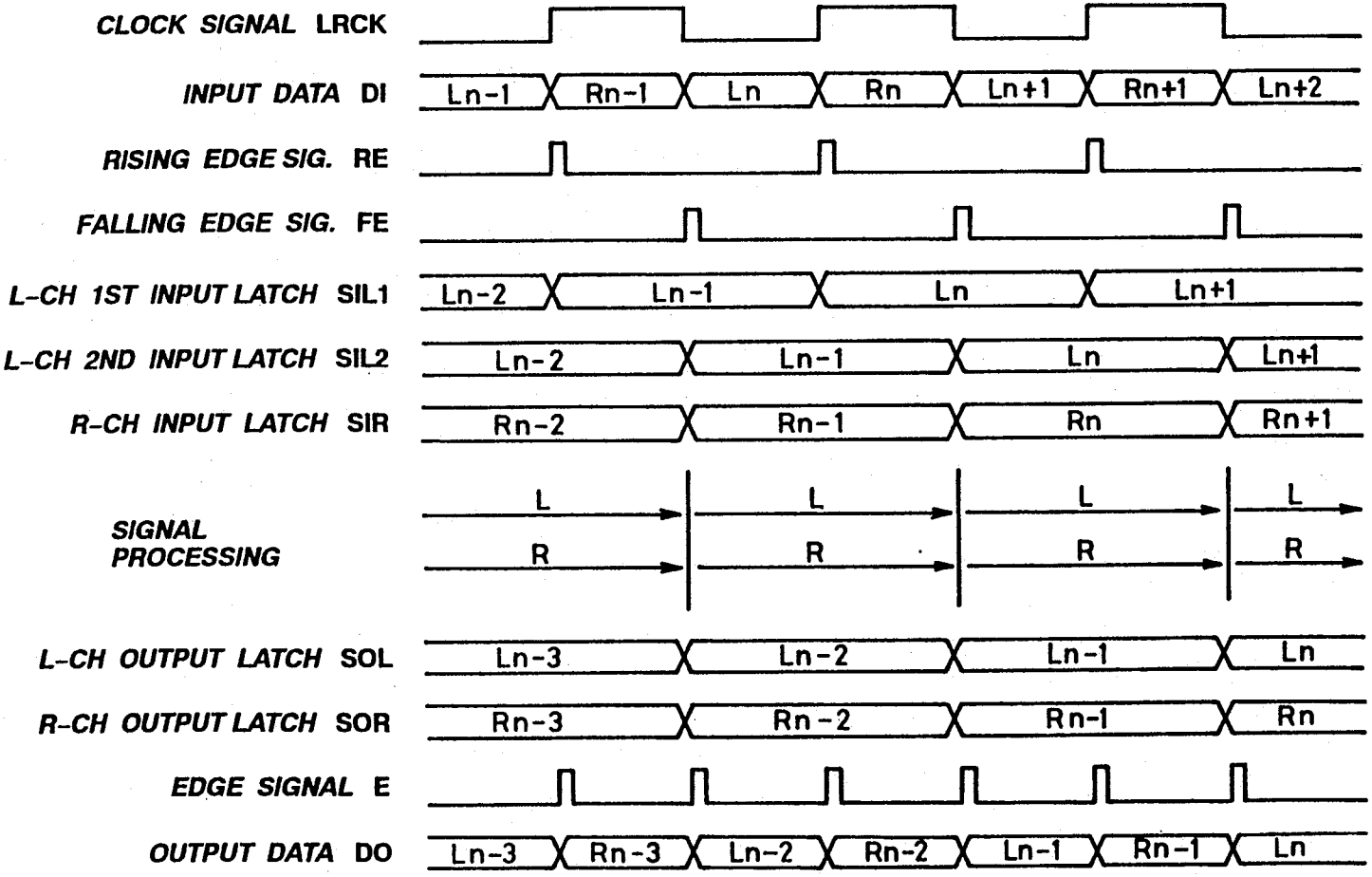
FIG. 4 is a timing chart for explaining the operation of the embodiment shown in FIG. 3.

The above operation can be readily understood from the timing chart of FIG. 4. The signal processing for the R-ch data and the L-ch data will be started at the timing when both the data are ready in the L-channel dedicated input latch circuit 12*c* and the R-channel dedicated input latch circuit 12*a*, respectively, i.e., at the falling edge timing of the control signal LRCK. Accordingly, in this case, these L-ch data and R-ch data can be processed simultaneously by the arithmetic unit 2 and the data delay control circuit 4. Therefore, unlike in the conventional digital signal processor, it is not necessary to wait for the L-ch data and the R-ch data to be ready for signal processing.

As regards the signal outputting, the L-ch data latched in the L-channel dedicated output latch circuit 13*b* and the R-ch data latched in the R-channel dedicated output latch circuit 13*a* are selected by the multiplexer 15 in accordance with the control signal LRCK in such a way that, the L-ch data is selected when the control signal LRCK is at an "L" level, whereas the R-ch data is selected when the control signal LRCK is at an "H" level. The selected data is loaded into the conversion circuit 11 in accordance with the edge signal E of the control signal LRCK, which is supplied from the edge detection circuit 14. After the data loaded in the conversion circuit 11 is converted from parallel to serial data, it is outputted as the output data DO. Thus, since the L-ch data and the R-ch data are processed simultaneously, limitation to the signal processing time can be effectively removed.

Additionally, in this embodiment, the L-ch data was inputted prior to the R-ch data, but the R-ch data may be inputted prior to the L-ch data. In this case, in FIG. 3, the R-channel dedicated input circuit 12*a* may be replaced by an L-channel dedicated input circuit, and the two L-channel dedicated input latch circuits 12*b*, 12*c* may be replaced by two R-channel dedicated input latch circuits.

As has been described hereinabove, in the digital signal processor according to the present invention, since the inputted R-ch data and L-ch data are outputted to the internal bus at the same timing, the L-ch data and the R-ch data can be processed simultaneously. As a result, the present invention has an advantage that the signal processing time is not limited by the input/output data.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A digital signal processor having a data input/output circuit for inputting/outputting a right channel data and a left channel data of an audio signal said data input/output circuit comprising:

a data conversion circuit for performing a serial-parallel conversion on the inputted data and for performing a parallel-serial conversion on an output data to be outputted, said serial-parallel conversion and said parallel-serial conversion being performed in accordance with a clock signal;

an R-channel dedicated input latch means and an L-channel dedicated input latch means for latching the inputted R-channel and L-channel data from said data conversion circuit, respectively, said R-channel dedicated input latch means latching the inputted R-channel data in response to a falling edge detection signal of a control signal and said L-channel dedicated input latch means latching the inputted L-channel data from said data conversion circuit in response to a rising edge detection signal of said control signal;

Means for simultaneously processing the inputted R-channel and L-channel data; an R-channel dedicated output latch circuit and an L-channel dedicated output latch circuit for latching the R-channel data and the L-channel data to be outputted, respectively;

an output data switching circuit for selecting, in accordance with the control signal, the data to be outputted therefrom between the R-channel data and the L-channel data sent respectively from said R-channel and L-channel dedicated output latch circuits, the data selected by said output data switching circuit being loaded into said data conversion circuit in response to said falling and rising edge detection signals of the control signal; and a timing signal generating means for controlling the timings of data latching at each of said input latch means and of data loading from said output data switching circuit to said data conversion circuit, said timing signal generating means including a falling edge detection circuit for detecting a falling edge of said control signal to produce said falling edge detection signal and a rising edge detection circuit for detecting a rising edge of said control signal to produce said rising edge detection signal.

2. A digital signal processor according to claim 1, wherein said L-channel input latch means comprises a first L-channel dedicated input latch circuit for latching the L-channel input data in response to said rising edge detection signal, and a second L-channel dedicated input latch circuit connected in series with said first L-channel dedicated input latch circuit, for latching an output from said first L-channel dedicated input latch circuit in response to said falling edge detection signal.

3. A digital signal processor according to claim 1, wherein said timing signal generating means further comprising an edge detection circuit for detecting edges of said control signal to produce an edge detection signal, and the output from said data switching circuit is loaded into said data conversion circuit in response to said edge detection signal.

4. A digital signal processor according to claim 1, wherein said output data switching circuit is a multiplexor.

5. A digital signal processor according to claim 1, wherein said means for simultaneously processing the inputted R-channel and L-channel data comprises:

an internal bus connected with said input/output circuit;

a data memory unit connected with said internal bus, for storing an internal data;

an arithmetic circuit connected with said internal bus, for performing digital filtering processing on the inputted data;

a data delay control circuit connected with said internal bus, for performing digital delay processing on the inputted data; and a microprogram control circuit connected with said internal bus, for controlling said data input/output circuit, said data memory unit, said arithmetic circuit and a data delay control circuit.

* * * * *